US005265926A

United States Patent [19]

DiNardo

[11] Patent Number: 5,265,926

[45] Date of Patent: Nov. 30, 1993

[54] GOLF BALL RETRIEVER

[76] Inventor: Frank L. DiNardo, 200 N. Yates Ave., Mount Prospect, Ill. 60056

[21] Appl. No.: 878,606

[22] Filed: May 5, 1992

[51] Int. Cl.[5] ..... A63B 47/02

[52] U.S. Cl. ..... 294/19.2; 294/103.1

[58] Field of Search ..... 294/19.1, 19.2, 19.3, 294/103.1, 110.1; 273/32 F, 162 E

[56] References Cited

U.S. PATENT DOCUMENTS

| | | | |
|---|---|---|---|
| 1,452,679 | 4/1923 | Fisher . | |
| 2,205,345 | 6/1940 | Christensen | 294/19.2 |
| 2,524,527 | 10/1950 | Jasmer | 294/19.2 |
| 2,623,769 | 12/1952 | Kegley, Sr. | 294/19.2 |
| 2,658,785 | 11/1953 | Jones | 294/19.2 |
| 2,924,482 | 2/1960 | Gibson | 294/19.3 X |
| 2,962,321 | 11/1960 | Fowler et al. | 294/19.2 |
| 3,029,097 | 4/1962 | Ward | 294/19.2 |
| 3,038,751 | 6/1962 | Stafford | 294/19.2 |
| 3,046,044 | 7/1962 | Christle | 294/19.2 |
| 3,136,573 | 6/1964 | Harke | 294/19.2 |
| 3,547,477 | 12/1970 | Young | 294/19.2 |
| 3,770,308 | 11/1973 | Faber et al. | 294/19.2 |
| 3,887,225 | 6/1975 | McKee | 294/19.2 |
| 4,046,413 | 9/1977 | Jenings | 294/19.2 |
| 4,136,901 | 1/1979 | Walter | 294/19.2 |
| 4,493,503 | 1/1985 | Jeninga | 294/19.2 |
| 4,746,156 | 5/1988 | Kremer | 294/19.2 |
| 4,783,926 | 11/1988 | McKinney et al. | 294/19.3 X |

*Primary Examiner*—David M. Mitchell
*Assistant Examiner*—Dean J. Kramer
*Attorney, Agent, or Firm*—Wallenstein, Wagner & Hattis, Ltd.

[57] ABSTRACT

The present invention is a device for retrieving an object such as a golf ball. In one preferred embodiment, the retriever comprises a handle, a stationary member or loop that is rigidly attached to the handle, a reactive member or loop that is pivotally attached to the stationary member and a spring for biasing the reactive member substantially perpendicular to the stationary member. In a second preferred embodiment, a pair of mounting members and a clip are added to allow the stationary member to be rotated and lock into any desired position relative to the handle. Prior to capturing the object, the retriever is set such that the stationary and reactive members are substantially parallel. The retriever is then directed so that when the spring contacts an object, it trips the spring and causes the reactive member to pivot into a substantially perpendicular position with respect to the stationary member, capturing the object inside the stationary and reactive members.

20 Claims, 3 Drawing Sheets

GOLF BALL RETRIEVER

TECHNICAL FIELD

The present invention relates to a device for retrieving objects such as golf balls.

Devices for retrieving golf balls are well known. Examples of such retrievers being scoops or single loop devices for capturing a golf ball, U.S. Pat. No. 2,524,527, a pair of loops for clamping around the ball, U.S. Pat. Nos. 1,452,679, 2,205,345, 3,887,225, 4,046,413 and 4,746,156, and a pair of loops and a bar for capturing the ball, U.S. Pat. Nos. 3,029,097 and 4,046,413, the disclosures of which are incorporated in their entirety by reference herein.

A well designed golf ball retriever should be simple to operate and have a high rate of success in capturing the ball, whether the ball is in water, mud, sand, tall grass, foliage or the cup. The retriever should also be light weight, compact and have as few parts as possible to reduce costs and increase its useful life.

A common problem with known retrievers is that they are difficult to operate and do not successfully capture and retrieve balls from a variety of environments. This problem is particularly prevalent when a ball is submerged in water. Mud and underwater plants can increase the difficulty in capturing the ball, and once captured, the viscosity of the water tends to push the ball out of the retriever when moved through the water.

The present invention solves these and other problems with prior art retrievers.

SUMMARY OF THE INVENTION

The present invention is a device for retrieving an object such as a golf ball. In a first preferred embodiment, the retriever comprises a handle, a stationary member that is rigidly attached to the handle, a reactive member that is pivotally attached to the stationary member and a means for biasing the reactive member substantially perpendicular to the stationary member. The biasing means is preferably a spring positioned inside the reactive member. In a second preferred embodiment, a pair of mounting members are added to allow the stationary member to be rotated and locked into place at a desired angle.

Prior to capturing the object, the retriever is set so that the stationary and reactive members are substantially parallel. An operator then directs the retriever so that the spring contacts the object. This trips the spring and causes the reactive member to pivot into a substantially perpendicular position with respect to the stationary member—the object being captured inside the stationary and reactive members.

One advantage of the present invention is its ease of operation. The retriever is easily set, and once set, the operator need only direct the spring toward the object. This ease of operation result in a high success rate in capturing objects such as golf balls, even when the object is submerged in water.

Another advantage of the present invention is that the object is enclosed or captured inside or between the stationary and reactive members. The object will not fall out if the retriever is rotated or shaken. Thus, the viscous forces of water will not push the ball out of the retriever when it is moved through the water.

A further advantage of the present invention is its simple construction and few parts which make it economical to consumers. The retriever is also compact and light weight.

A still further advantage of the present invention is that even if the retriever is inadvertently tripped before capturing an object, it can still be used to retrieve an object such as a golf ball, even when the ball is resting on soft mud, sand or underwater foliage.

Other features and advantages of the invention will be apparent from the following specification and drawings.

DETAILED DESCRIPTION

Figure 1:
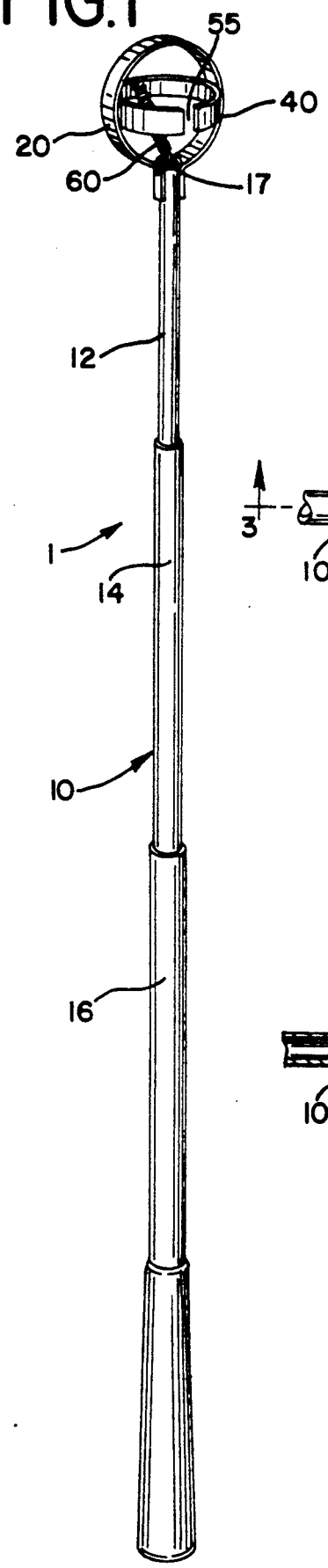
FIG. 1 is a plan view of the retriever with a telescoping handle.

While this invention is susceptible of embodiments in many different forms, there is shown in the drawings and will herein be described in detail, two preferred embodiments of the invention with the understanding that the present disclosure is to be considered as an exemplification of the principles of the invention and is not intended to limit the broad aspects of the invention to the embodiments illustrated.

As shown in FIG. 1, the present invention is a device for retrieving objects such as golf balls and is shown generally by reference number 1. The retriever 1 generally comprises a handle 10, a stationary loop or member 20, a reactive loop or member 40 and a means for biasing the reactive member to pivot into a preferable substantially perpendicular position with respect to the stationary member. Although the figures show reactive and stationary members 20 and 40 as circular loops for facilitating the capture of a spherical object such as a golf ball 2, it should be understood that these members could be shaped in many different ways to facilitate the capture of a variety of differently shaped objects. It should be noted that retriever 1 works equally well from either side 3 or 5, and that handle 10 and loops 20 and 40 are prefer-ably made of a light weight, rigid material, such as aluminum or plastic.

As shown in FIG. 1, handle 10 is preferably a telescoping handle made of several tubes 12, 14 and 16, each tube fitting inside the other with a fit that will permit telescoping and yet snug enough to remain extended. However, it should be understood that other types of handles could be implemented. Tubes 12, 14 and 16 are preferably hollow with open end 17 being secured to stationary member 20.

Figure 2:
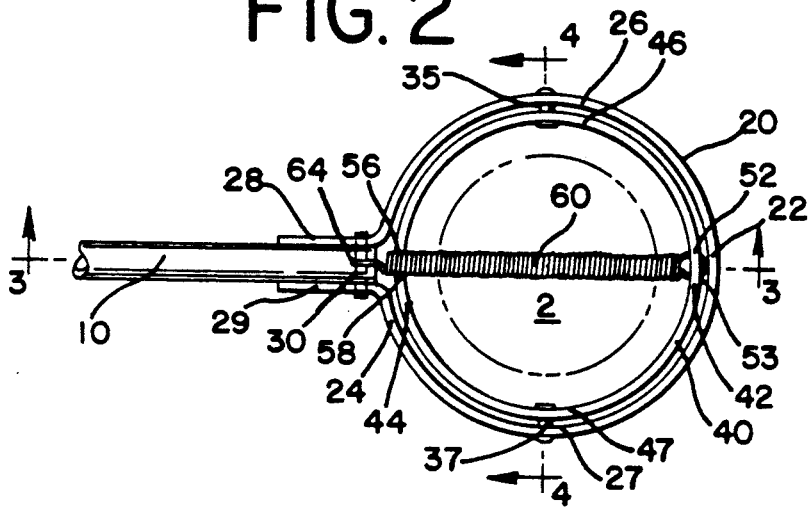
FIG. 2 is a top plan view of the ball retriever in its set position and positioned over a golf ball shown in phantom.
Figure 3:
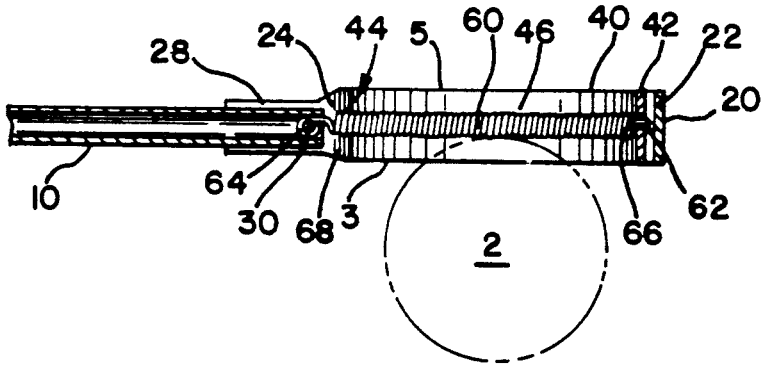
FIG. 3 is a cross-sectional view taken along the lines 3—3 of FIG. 2 and showing a side view of the retriever in its set position with the spring engaging a golf ball shown in phantom lines.
Figure 4:
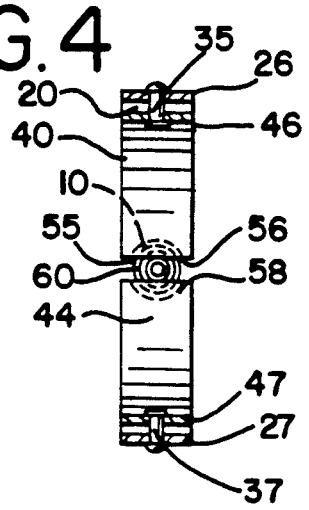
FIG. 4 is a cross-sectional view shown taken along the lines 4—4 of FIG. 2 showing the retriever in its set position and the jaws of the reactive member frictionally engaging the spring.

As shown in FIGS. 2–4, stationary member 20 can take the form of a loop having a top 22, a bottom 24 and two side portions 26 and 27. Bottom portion 24 of stationary loop 20 preferably has tabs 28 and 29 which conform to the shape of and are rigidly attached to the end 17 of handle 10.

A pin 30 or similar fastener may be used to rigidly secure stationary loop 20 to handle 10. This is done by forming holes in tabs 28 and 29 and handle end 17. Pin 30 is inserted through these holes and its ends are riveted or flattened to keep it from falling out and to ensure that tabs 28 and 29 fit snugly against handle 10.

Pivot pins 35 and 37 are preferably inserted into the side portions 26 and 27 of stationary loop 20 to facilitate the pivotal attachment of reactive member 40 within the stationary loop 20. Pivot pins 35 and 37 are preferably spaced 180° apart. As illustrated, they are spaced 90° from pin 30.

Reactive member 40 is also shown in the form of a loop and has a top 42, a bottom 44 and two side portions 46 and 47. For ease of construction and compactness, reactive loop 40 is preferably sized to fit inside stationary loop 20. However, it should be understood that reactive loop 40 could be adapted to fit outside stationary loop 20. Side portions 46 and 47 have holes for receiving pivot pins 35 and 37. In this way, pivot pins 35 and 37 pivotally attach reactive or pivoting loop 40 to stationary loop 20. Holes 52 and 53 are preferably provided in the top portion 42 of reactive loop 40 for facilitating the attachment of the ends of a biasing spring 60 which serves to bias reactive loop 40 into a perpendicular position with respect to stationary loop 20. It should be understood that other biasing means may be used. In the preferred embodiment, spring 60 is a cylindrical helical spring with hooks 62 and 64 at each of its two ends 66 and 68. Hooks 62 and 64 are formed by bending the outer helical loops of spring 60 perpendicular to the cylindrical spring. One end 66 of spring 60 is preferably attached to the top portion 42 of reactive loop 40 by passing hook 62 through holes 52 and 53. The other end 68 of spring 60 is preferably attached to handle 10 by looping hook 64 around pin 30. Clips may also be used to attach the ends 66 and 68 of spring 60 to the top portion 42 of reactive loop 40 and pin 30. One end 66 of spring 60 is preferably attached opposite pin 30 or 180° around loop 40, but the retriever 1 will also operate if attached only 160° from pin 30.

To operate the retriever 1, reactive loop 40 is set substantially parallel to stationary loop 20. (See FIGS. 2–4). In this set position, spring 60 is stretched and exerts a force on reactive loop 40. Because spring 60 is substantially parallel to loops 20 and 40 when in this set position, the force exerted by spring 60 on reactive loop 40 is met by an equal and opposite force exerted by pins 35 and 37. Thus, reactive loop 40 remains in its set position inside the stationary loop 20.

As shown in FIGS. 1–4, the bottom portion 42 of reactive loop 40 is preferably notched to accommodate spring 60 when in the set position. Notch 55 has jaws 56 and 58 that are spaced apart less than one diameter of spring 60. Therefore, jaws 56 and 58 frictionally engage spring 60 in the set position. This frictional contact helps prevent the retriever 1 from inadvertently triggering while an operator is directing the retriever towards the object. The frictional engagement does not substantially inhibit the object from dislodging or triggering spring 60 to rotate the reactive loop 40 inside the stationary loop 20.

When an object contacts and pushes against spring 60, spring 60 and reactive loop 40 pivot slightly out of parallel with stationary loop 20. Top portion 42 of loop 40 rotates away from the object and this results in a misalignment of forces exerted on reactive loop 40 by spring 60 and pins 35 and 37. The misalignment of forces creates a torque that causes the top portion 42 of reactive loop 40 to rotationally accelerate toward spring 60 which rapidly returns to its relaxed position, and thereby capture the object to be retrieved.

Figure 5:
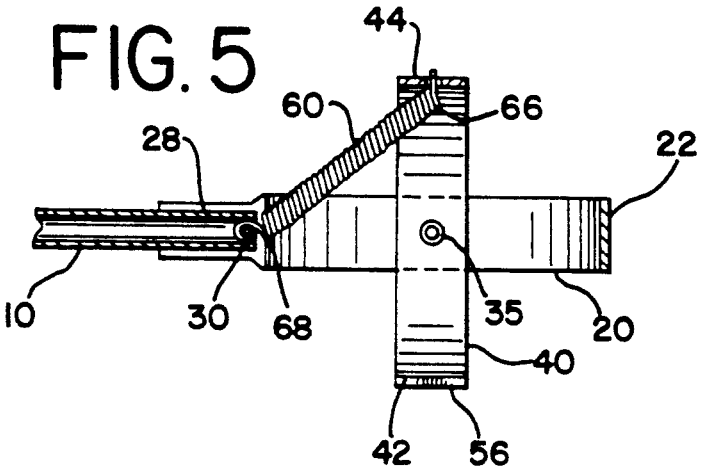
FIG. 5 is a cut-away view of the side of the retriever in its perpendicular position after capturing the golf ball.
Figure 6:
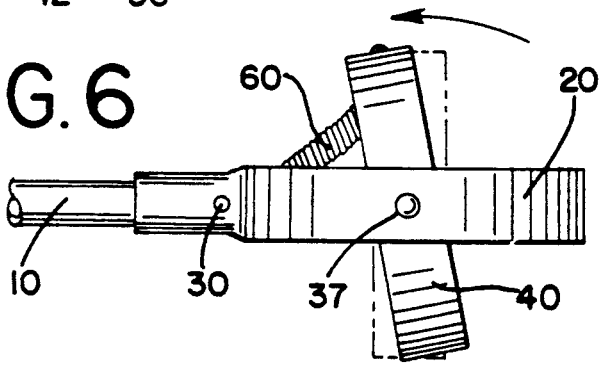
FIG. 6 is a side plan view of the retriever showing the spring recoiling when retrieving an object.

As shown in FIG. 5 and 6, spring 60 is sized so that in its relaxed position, reactive loop 40 is substantially perpendicular to stationary loop 20. The perpendicular orientation is preferred because it minimizes the gap between the top portions 22 and 42 of loops 20 and 40. The smaller this gap is, the less likely an object such as golf ball 2 will escape.

Figure 7:
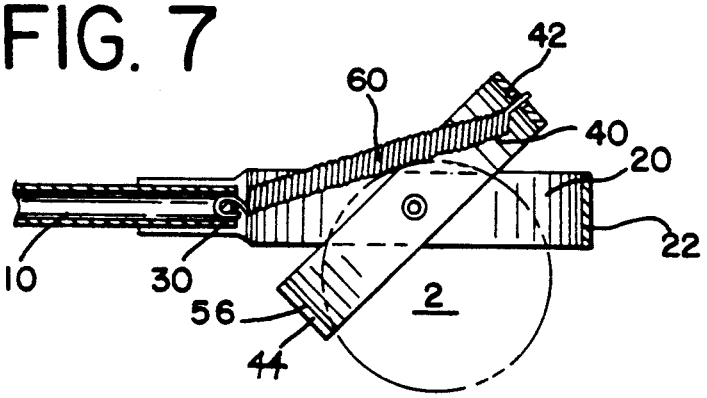
FIG. 7 is a plan view of the retriever showing a golf ball being forced between the stationary and reactive members.

As shown in FIG. 7 retriever 1 may be used to capture an object even after spring 60 has been tripped and reactive loop 40 is in its perpendicular position. This is done by positioning the object such as golf ball 2 between stationary member 20 and reactive member 40, and pushing it against reactive member 40. This causes reactive member 40 to pivot and the gap between the top portions 22 and 42 of loops 20 and 40 to increase, thereby allowing the object to fit between loops 20 and 40. Once inside, reactive loop 40 returns to its perpendicular position.

Figure 8:
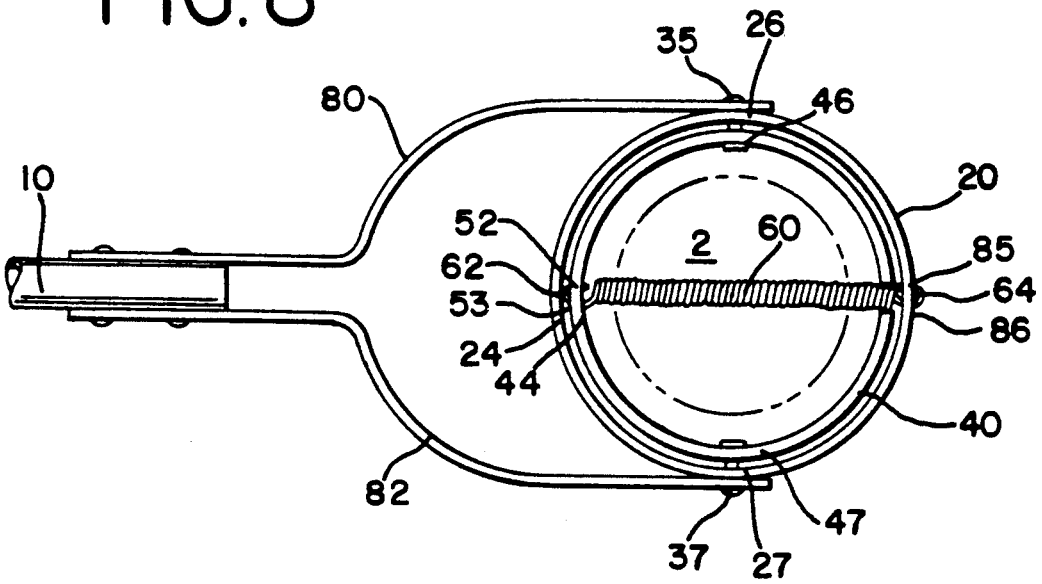
FIG. 8 is a top plan view showing a second embodiment of the invention with stationary member set parallel to the mounting members and the reactive member positioned over a golf ball shown in phantom.
Figure 9:
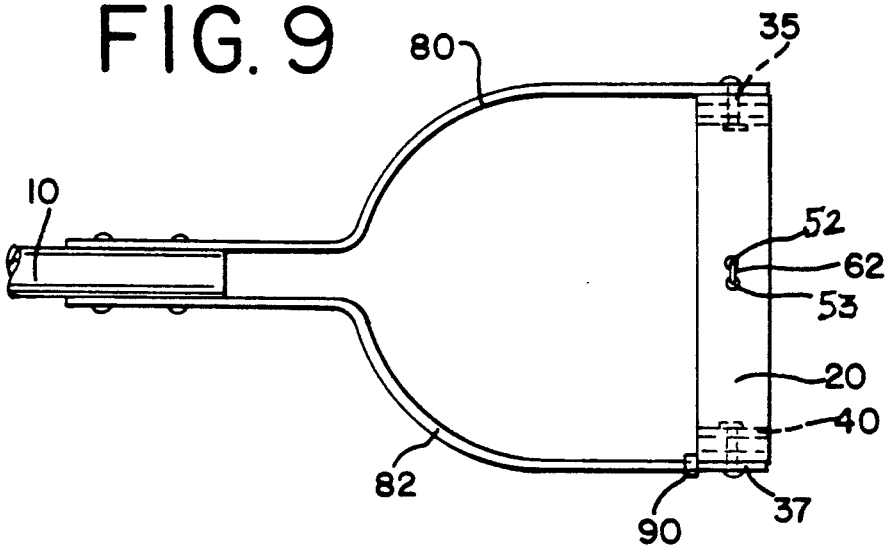
FIG. 9 is a top plan view showing the stationary member pivoted 90° with respect to the mounting members.
Figure 10:
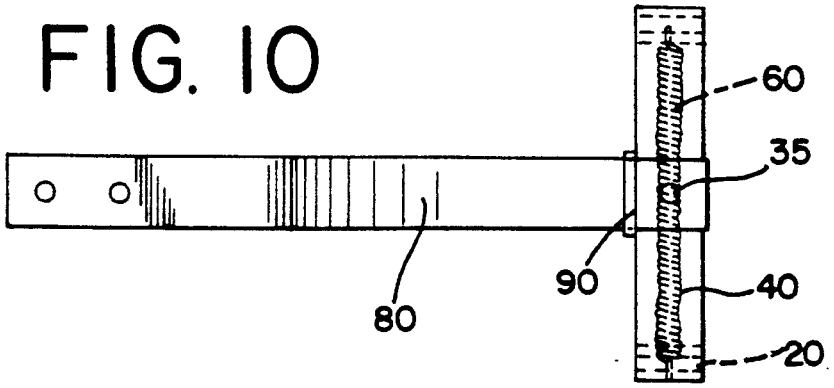
FIG. 10 is a side cut-away view showing the stationary member pivoted 90° with respect to the mounting members.

FIGS. 8, 9 and 10 show a second preferred embodiment of the invention. In this embodiment, retriever 1 includes mounting members 80 and 82 for attaching stationary member 20 to handle 10. In this embodiment, stationary member 20 is preferably a complete loop as tabs 28 and 29 are no longer needed. Instead, pivot pins 35 and 37 are used to pivotally attach stationary loop 20 to mounting members 80 and 82. Holes 85 and 86 are also preferably added to loop 20 for attaching spring hook 64. Reactive loop 40 and spring 60 remain substantially the same as in the first embodiment.

FIG. 8 shows stationary loop 20 positioned parallel to mounting members 80 and 82. Reactive loop 40 is in its set position. A friction clip 90 is positioned to prevent stationary loop 20 from rotating during use. Set in this way, spring 60 is parallel to handle 10, so that the second embodiment operates in substantially the same manner as the first.

FIGS. 9 and 10 illustrate the stationary loop 20 rotated 90° and spring 60 perpendicular to handle 10 when in the set position. Clip 90 holds stationary loop 20 in place. Although shown rotated 90°, it should be understood that stationary loop 20 can be locked in place at any desired angle so that an operator can position spring 60 to more easily contact an object.

In both of the above embodiments, the stiffness of spring 60 is important. The stiffness of spring 60 defines its resistance to stretching or bending, and the forces it will exert on reactive loop 40. The force of the spring is important for successfully capturing the object from soft mud, tall grass, foliage, etc., and preventing the object from escaping.

As mentioned above, when spring 60 is triggered, it causes reactive member 40 to rotationally accelerate about pins 35 and 37. The angular momentum of reactive loop 40 tends to cause it to rotate beyond the desired perpendicular position. This in turn, causes spring 60 to bend inwardly upon itself as shown in FIG. 6. Because spring 60 is preferably a cylindrical helical spring of predetermined length and diameter, it resists this inward bending and causes loop 40 to quickly come to rest in the desired perpendicular position. Stationary loop 20 and reactive loop 40 also have predetermined dimensions that depend on the size and shape of the object being captured. Loops 20 and 40 should be sized to provide the largest area possible for capturing the object, but must also ensure that the object will not fall out once captured.

When the object being retrieved is a standard size golf ball 2, spring 60 preferably has a relaxed cylindrical length of 1 ⅞ inches, a diameter of 3/16 inch, and a stiffness of 0.22 lbs. initial tension. Stationary and reactive loops 20 and 40 are preferably circular in shape, loop 20 having a diameter of about 2 inches and loop 40 having a diameter of about 1 ¾ inches Loops 20 and 40 are also preferably 5/16 ½ inch wide and 0.07 to 0.10 inch thick. However, it should be understood that the above dimensions can vary without rendering the device (1) inoperable.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A device for retrieving an object comprising:
a handle;
a stationary loop rigidly attached to said handle;
a reactive loop pivotally attached to said stationary loop; and
means for biasing said reactive loop substantially perpendicular to said stationary loop, each of said loops substantially surrounding the object when positioned substantially perpendicular to each other.

2. The retriever of claim 1, wherein said reactive loop is positioned inside said stationary loop and is adapted to rotate relative thereto in response to said biasing means.

3. The retriever of claim 2, wherein said stationary loop and said reactive loop have top, bottom and side portions, said bottom portion of said stationary loop being attached to said handle and said side portions of said reactive loop being pivotally attached to said side portions of said stationary loop.

4. The retriever of claim 3, wherein said biasing means is a spring.

5. The retriever of claim 4, wherein said spring is a cylindrical helical spring having two ends, one end being attached to said top portion of said reactive loop and said other end being attached to said handle.

6. The retriever of claim 5, wherein said bottom portion of said reactive loop is notched and said spring passes through said notch.

7. The retriever of claim 6, wherein said notch has jaws and said jaws frictionally engage said spring.

8. The retriever of claim 7, wherein said spring has a diameter of about 3/16 inch and a stiffness of about 0.22 lbs., and said stationary and reactive loops are substantially circular in shape with diameters of about 2 and 1 ¼ inches respectively.

9. The retriever of claim 1, wherein said handle is a telescoping handle.

10. A device for retrieving objects comprising:
a handle;
a generally U-shaped mounting member rigidly attached to said handle; p1 a stationary loop pivotally attached to said mounting member;
a clip for holding said stationary loop in a set position relative to said mounting member;
a reactive loop pivotally attached to said stationary loop; and
means for biasing said reactive loop substantially perpendicular to said stationary loop, each of said loops surrounding the object when positioned substantially perpendicular to each other.

11. The retriever of claim 10, wherein said reactive loop is positioned inside said stationary loop.

12. The retriever of claim 11, wherein said stationary and reactive loops have top, bottom and side portions, said side portions of said stationary loop being attached to said mounting member and said side portions of said reactive loop being pivotally attached to said side portions of said stationary loop.

13. The retriever of claim 12, wherein said biasing means is a spring.

14. The retriever of claim 13, wherein said spring is a cylindrical helical spring having two ends, one end being attached to said reactive loop and said other end being attached to said stationary loop.

15. The retriever of claim 14, wherein said reactive loop is notched and said spring passes through said notch.

16. The retriever of claim 15, wherein said notch has jaws and said jaws frictionally engage said spring.

17. The retriever of claim 16, wherein said spring has a diameter of about 4/16 inch and a stiffness of about 0.22 lbs., and said stationary and reactive loops are substantially circular in shape with diameters of about 2 and 1 ¾ inches respectively and widths of about ¼ to ½ inch.

18. The retriever of claim 10, wherein said handle is a telescoping handle.

19. A device for retrieving objects comprising:
a telescoping handle;
a stationary loop attached to said handle, said stationary loop having top, bottom and side portions;
a reactive loop positioned inside said stationary loop and having top, bottom and side portions, said side portions of said reactive loop being pivotally attached to said side portions of said stationary loop; and
a spring for biasing said reactive loop substantially perpendicular to said stationary loop, each of said loops substantially surrounding the object when positioned substantially perpendicular to each other, said spring having two ends, one end being attached to said top portion of said reactive loop and said other end being attached to said handle.

20. The retriever of claim 19, wherein said bottom portion of said reactive loop is notched, said spring passing through said notch, and said notch having jaws that frictionally engage said spring.

* * * * *

UNITED STATES PATENT AND TRADEMARK OFFICE

CERTIFICATE OF CORRECTION

PATENT NO. : 5,265,926

DATED : NOVEMBER 30, 1993

INVENTOR(S) : FRANK L. DINARDO

It is certified that error appears in the above-identified patent and that said Letters Patent is hereby corrected as shown below:

Column 5, line 28, after "5/16," insert --to--.

Column 6, line 7, delete "1/4" and insert --3/4--.

Column 6, line 13, delete "p1" and start a new paragraph after ";."

Column 6, line 42, delete "4/16" and insert --3/16--.

Signed and Sealed this

Twenty-sixth Day of April, 1994

*Attest:*

*Attesting Officer*

Bruce Lehman

BRUCE LEHMAN

*Commissioner of Patents and Trademarks*